US007530767B2

(12) United States Patent
Davidson, Sr.

(10) Patent No.: US 7,530,767 B2
(45) Date of Patent: May 12, 2009

(54) TRENCH BOX SAFETY LADDER

(75) Inventor: Tom Randy Davidson, Sr., Griffin, GA (US)

(73) Assignee: Davidson Equipment Leasing LLLP, Sunnyside, GA (US)

( * ) Notice: Subject to any disclaimer, the term of this patent is extended or adjusted under 35 U.S.C. 154(b) by 33 days.

(21) Appl. No.: 11/833,664

(22) Filed: Aug. 3, 2007

(65) Prior Publication Data

US 2008/0229702 A1 Sep. 25, 2008

Related U.S. Application Data

(60) Provisional application No. 60/835,800, filed on Aug. 4, 2006.

(51) Int. Cl.
*E02D 17/08* (2006.01)

(52) U.S. Cl. ..... 405/282; 405/283

(58) Field of Classification Search ..... 405/282, 405/283, 272

See application file for complete search history.

(56) References Cited

U.S. PATENT DOCUMENTS

| | | | |
|---|---|---|---|
| 1,340,688 | A | 5/1920 | Thollander |
| 2,957,542 | A | 10/1960 | Rizzuto |
| 2,963,178 | A | 12/1960 | Walker |
| 2,965,195 | A | 12/1960 | Paschen |
| 3,029,607 | A | 4/1962 | Millerbernd |
| 3,420,558 | A | 1/1969 | Whitten, Jr. |
| 3,455,414 | A | 7/1969 | Higgins |
| 3,591,123 | A | 7/1971 | Edwards |
| 3,727,413 | A | 4/1973 | Christen |
| 3,766,740 | A | 10/1973 | Teegen |
| 3,922,866 | A | 12/1975 | Benning |
| 4,151,895 | A | 5/1979 | Rasada, Jr. et al. |
| 4,319,791 | A | 3/1982 | Gibson |
| 4,546,855 | A | 10/1985 | Lyons |
| 4,719,989 | A | 1/1988 | Ritten |
| 5,282,339 | A | 2/1994 | Devlin et al. |
| 5,295,557 | A | 3/1994 | Taylor |
| 5,401,122 | A | 3/1995 | Pate, Jr. |
| 5,931,258 | A | 8/1999 | Lorentz |
| 6,155,750 | A | 12/2000 | Wu et al. |
| 6,315,077 | B1 | 11/2001 | Peacock et al. |
| 6,607,053 | B1 | 8/2003 | Warren |
| 6,907,957 | B1 | 6/2005 | Couch |
| 6,932,193 | B2 | 8/2005 | Tombarello |
| 7,140,808 | B2 | 11/2006 | Raspotnik |
| 2007/0175699 | A1 * | 8/2007 | Steblinski ..... 182/82 |

FOREIGN PATENT DOCUMENTS

| | | |
|---|---|---|
| BE | 563781 | 1/1958 |
| DE | 4233484 | 4/1993 |
| FR | 2130937 | 11/1972 |
| GB | 2432872 | * 6/2007 |

(Continued)

*Primary Examiner*—Frederick L Lagman
(74) *Attorney, Agent, or Firm*—Kilpatrick Stockton LLP

(57) ABSTRACT

Various embodiments of the present invention relate to trench box safety ladders and methods of constructing trench boxes with safety ladders. In one embodiment, a trench box comprises two side walls with a plurality of supports between the two walls, a built-in ladder within the inner face of a side wall, and an extension ladder positioned on the top face of the side wall.

18 Claims, 6 Drawing Sheets

FOREIGN PATENT DOCUMENTS

| | | |
|---|---|---|
| JP | 57000234 | 1/1982 |
| JP | 10339042 | 12/1998 |
| JP | 2002147161 | 5/2002 |
| JP | 2006307605 | 11/2006 |
| JP | 2006342530 | 12/2006 |

* cited by examiner

TRENCH BOX SAFETY LADDER

CROSS-REFERENCE TO RELATED APPLICATION

The present application claims priority to U.S. Provisional Patent Application No. 60/835,800, titled "Trench Box Safety Ladder," filed Aug. 4, 2006, the entire contents of which is incorporated herein by reference.

FIELD OF THE INVENTION

This invention relates generally to trench boxes and more specifically to apparatuses for allowing persons to ingress and egress the trench box and methods for retrofitting a trench box to include same.

BACKGROUND OF THE INVENTION

Trench boxes, such as those used to protect workers during excavation or other construction work, generally include two or more sides with support members that create a work area and protect workers or machinery during the performance of various tasks in the work area. The trench box may be inserted into a dug-out or excavated hole, ditch, or trench in the ground or otherwise. The sides of the trench box, typically made from metal such as steel or aluminum, assist in protecting workers and machinery by preventing dirt, rock, construction debris, or other material from falling into the trench box. A trench box also provides protection for the workers within the trench box from cave-ins of the surrounding soil. In some trench boxes, the sides may include an inner wall and an outer wall with a hollow area between the two walls. In other trench boxes, the sides may be solid piece of metal.

Conventional trench boxes often utilize a conventional ladder leaning against one side of the trench box and extending into the trench box to allow workers to enter and exit the trench box. The ladder, however, must be removed before some machinery, such as an excavator, can perform its work in the work area. Furthermore, the ladder could be inadvertently damaged and/or removed while workers are still in the trench box, thereby preventing them from exiting the trench box. The construction manager may face fines from the Occupational Safety Health Administration or other government agencies for workers' inability to exit the trench box if the ladder is removed or not in proper working function.

Conventional trench box ladders must be transported from the site of the trench box at the end of the workday to prevent the ladder from being stolen or to use the ladder at a different location. The ladder may be damaged, lost, or otherwise during movement and/or while located in the trench box and require frequent replacement. Replacing lost or damaged ladders may be frustrating to construction managers and become a relatively high expense.

Accordingly, a need exists for a structure that can allow workers to safely ingress and egress the trench box that is within reach of the workers without interfering with activities in the work area. A need also exists for a structure that is not susceptible to being stolen or damaged by work performed in the work area. A need also exists for a trench box that provides workers with a non-removable system for entering and exiting the trench box to protect worker safety and decrease the susceptibility to fines from a government agency.

BRIEF SUMMARY OF THE INVENTION

Aspects and embodiments of the present invention provide a trench box comprising a built-in ladder and extension ladder to allow a worker to ingress and egress the trench box and methods for retrofitting an existing trench box to create a structure for allowing a worker to ingress and egress the trench box.

In one embodiment, the present invention comprises a trench box comprising two side walls that are connected to each other via at least one support rod. A working space is formed between the two side walls. The trench box also includes a built-in ladder that is positioned within a cavity of a side wall. The cavity is positioned within an inner face of the side wall. The built-in ladder includes a plurality of spaced apart rungs that are located within the cavity. An extension ladder can be positioned on the top face of the side wall in proximity to the top of the built-in ladder.

In another embodiment, the present invention provides a method for retrofitting existing trench boxes with a built-in ladder and an extension ladder. In one embodiment, a trench box is provided that comprises a first side wall and a second side wall. Each side wall has an inner face, an outer face, a top face, and two end faces. A section of a inner face of a side wall is removed to form a cavity having cavity sides. A plurality of rungs are connected to the cavity sides. In some embodiments, at least two openings in the top face of the side wall are formed in proximity to the top of the cavity section. A sleeve is inserted into each opening. The sleeve is attached to the top face of the side wall and is adapted to receive an extension ladder.

These embodiments are mentioned not to limit or define the invention, but to provide examples of embodiments of the invention to aid understanding thereof. Embodiments are discussed in the Detailed Description where further description of the invention is provided. Advantages offered by the various embodiments of the present invention may be further understood by examining this specification.

BRIEF DESCRIPTION OF THE DRAWINGS

These and other features, aspects, and advantages of the present invention are better understood when the following Detailed Description is read with reference to accompanying drawings.

DETAILED DESCRIPTION OF THE INVENTION

The present invention relates generally to a trench box safety ladder that includes an apparatus for allowing ingress and egress to a working space in the trench box. In one embodiment, the present invention comprises a trench box having two side walls connected via support rods between the two side walls. In some embodiments, the trench box can include four walls, including the two side walls. A working space is formed between the two side walls. The trench box includes a built-in ladder that can be positioned within a cavity of a side wall and provide ingress and egress to the working space. The cavity can be within the inner face of the side wall. The built-in ladder comprises a plurality of spaced apart rungs that are located within the cavity. In some embodiments, the plurality of rungs do not extend beyond the plane of the inner face of the side wall. An extension ladder can be positioned on the top face of the side wall in proximity to the top of the built-in ladder. Some trench boxes according to various embodiments of the present invention can include a plurality of cavities, each containing a built-in ladder and, optionally, associated with an extension ladder.

Figure 1:
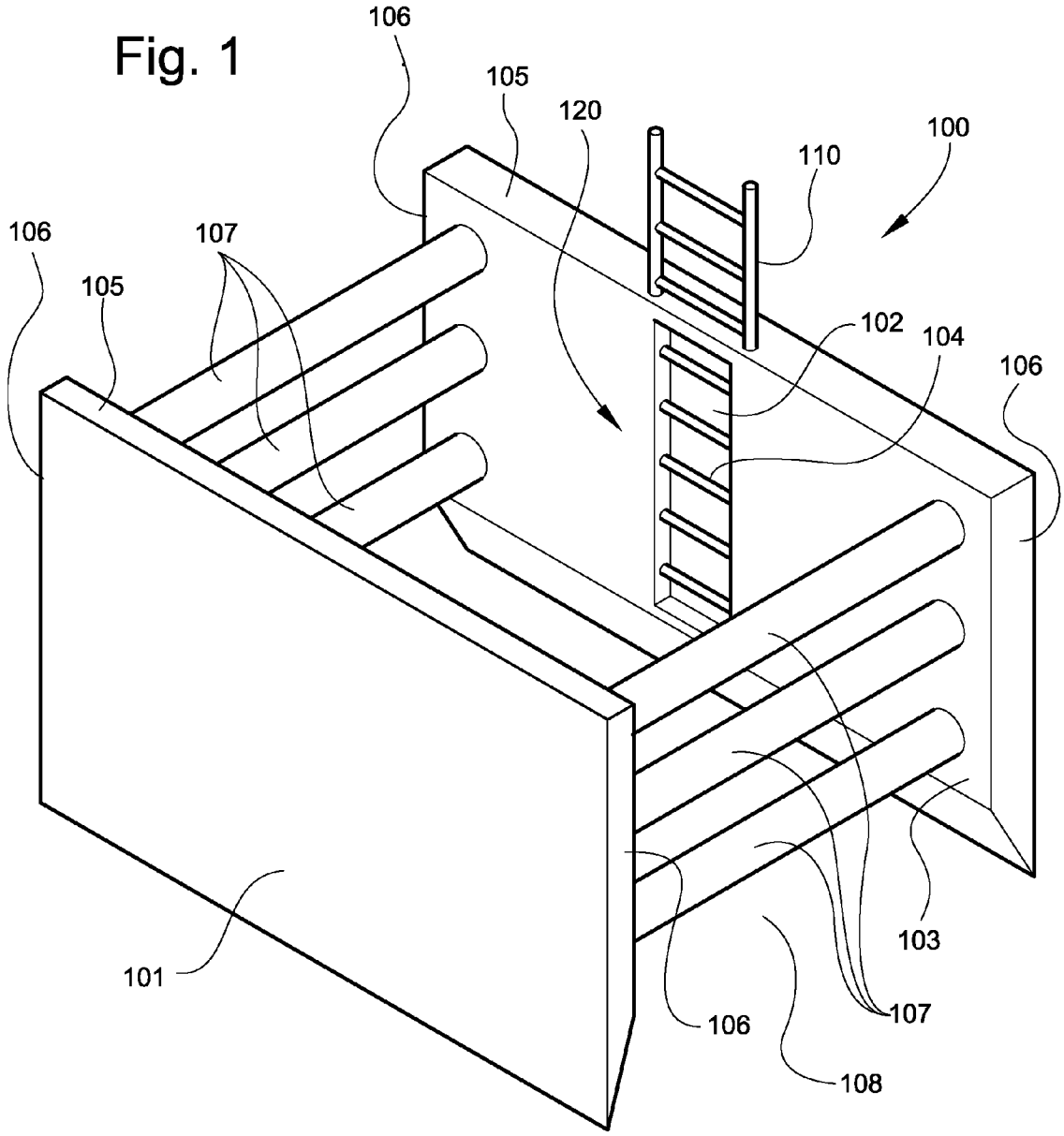
FIG. 1 illustrates a top, side perspective view of a trench box and safety ladder according to an embodiment of the present invention.

An embodiment of the present invention is depicted in FIG. 1. The trench box 100 can include two side walls. Each side wall has a top face 105, an outer face 101, an inner face 103, and end faces 106. Between the side walls, a plurality of support rods 107 can be attached to both side walls on the inner face 103. The plurality of support rods 107 can hold the side walls apart while forming a working space 108 between the two side walls. The support rods 107 can be made of steel, aluminum, and/or any other material adapted to provide a rigid support for the side walls. The trench box 100 can also include a safety ladder to allow persons to egress and ingress the trench box 100. The safety ladder can include a built-in ladder 120 having a plurality of rungs 104 and an extension ladder 110 positioned in proximity to the built-in ladder 120. For example, the extension ladder 110 may be positioned above the built-in ladder 120. The built-in ladder 120 can be positioned within a cavity 102 located within the inner face 103 of the side wall.

In some embodiments, the cavity 102 can be created during manufacture of the trench box side walls. In other embodiments, the cavity 102 can be created after the manufacture of the side wall. For example, an existing trench box can be modified to contain a built-in ladder 120 by creating a cavity in the inner face 103 of the side wall by removing a portion of the inner face 103.

For purposes of describing the dimensions of the cavity 102 of the present invention, the vantage point of a position within the working space of the trench box and facing the cavity 102 is used. In some embodiments, the cavity 102 can have a depth that is less than the depth of the side wall. In other embodiments, the cavity 102 can have a depth equal to the depth of the side wall. The depth of the cavity 102 can be selected to prevent the presence of the cavity 102 from interfering with the structural integrity of the side wall. The height of the cavity 102 can have substantially the same height as the height of the side wall of the trench box 100. The width of the cavity 102 can be a range of values. In some embodiments, the width can be substantially equal to that of a standard ladder width.

The rungs 104 can be installed within the cavity 102 and spaced apart at a distance that allows individuals to enter and exit the trench box 100. In some embodiments, the rungs 104 can be attached by welding the ends of the rungs 104 to a side boundary of cavity 102. In some embodiments, the rungs 104 can be substantially cylindrical, U-shaped, a right rectangular prism or cuboid, or otherwise any shape that allows a person to enter and exit the trench box 100. Right rectangular prism shaped rungs can be attached within the cavity 102 to create a platform-like step. Rungs 104 can be connected to any of the side wall or side boundaries of cavity 102. For example, rungs 104 may be welded to a portion of the side wall. The rungs 104 can be permanently attached and do not need to be removed to transport the trench box 100. Rungs 104 within the built-in ladder 120 according to the present invention may prevent accidental or purposeful removal while workers are in the trench box or otherwise. Furthermore, the rungs 104 may be positioned to not interfere with work, either by workers or machines, in the trench box and would be less likely, as compared to a conventional ladder, to be damaged by work in the trench box.

In some embodiments of the present invention, the rungs 104 within the cavity 102 do not protrude outside the hollow section of the cavity 102. The inner face 103 of the side wall can have a plane. This plane of the inner face 103 can be substantially represented by the surface material of the inner face 103. In some embodiments, the rungs 104 located within the cavity 102 do not extend beyond the plane of the inner face 103. The rungs 104, being contained within the cavity 102, may not interfere with the workers or machines in the working space.

In other embodiments, the cavity 102 is not created. For example, the built-in ladder 120 can include a plurality of rungs that can be attached directly to the side wall of the trench box.

Figure 2:
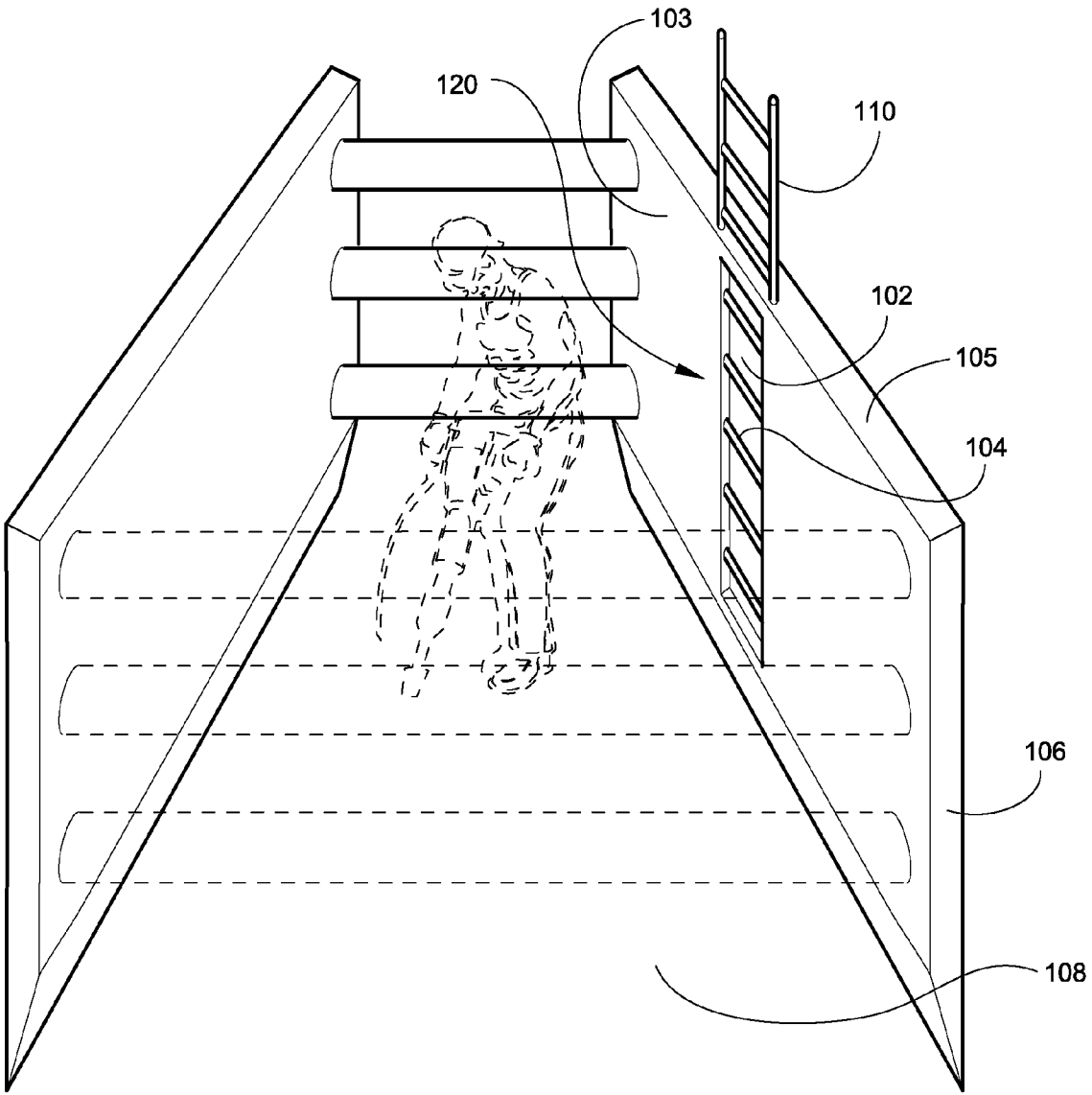
FIG. 2 illustrates an one-point perspective view of a trench box and safety ladder according to an embodiment of the present invention.

FIG. 2 represents one embodiment of the working space that includes a safety ladder, such as built-in ladder 120 that includes a plurality of rungs 104. The rungs 104 do not protrude past the plane of the inner face 103 of the side wall. As depicted in FIG. 2, the built-in ladder 120 does not interfere with the worker within the working space.

Referring again to the embodiment depicted FIG. 1, the extension ladder 110 provides additional rungs that a worker may use to exit the trench box 100 and the excavation site. The extension ladder 110 may be configured to rise to any height above the trench box. In one embodiment, the extension ladder 110 extends at least three feet above the top face 105 of the trench box 100. In some embodiments, the extension ladder 110 is at least three feet above the top of the excavation site in which the trench box 100 is positioned.

Figure 5:
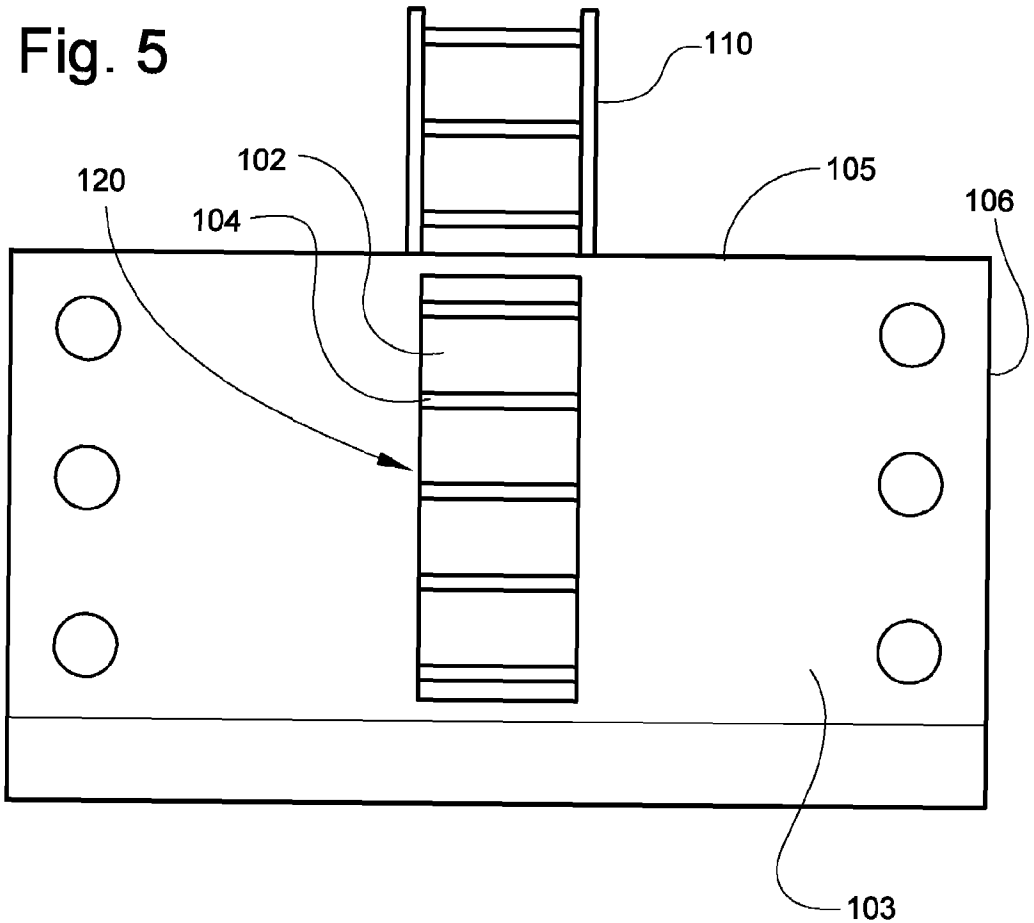
FIG. 5 is front, elevational view of a side wall in a trench box of an embodiment of the present invention.

As depicted in the front elevational view of one of the side walls containing the safety ladder in FIG. 5, an individual can enter and exit the working space through the use of the built-in ladder 120 and extension ladder 110. The extension ladder 110 provides a height which allows the individual to safely exit the trench box 100 and the excavation site. In addition, the height at which extension ladder 110 extends above the trench box 100 can be selected to meet and exceed governmental standards and regulations.

Figure 3:
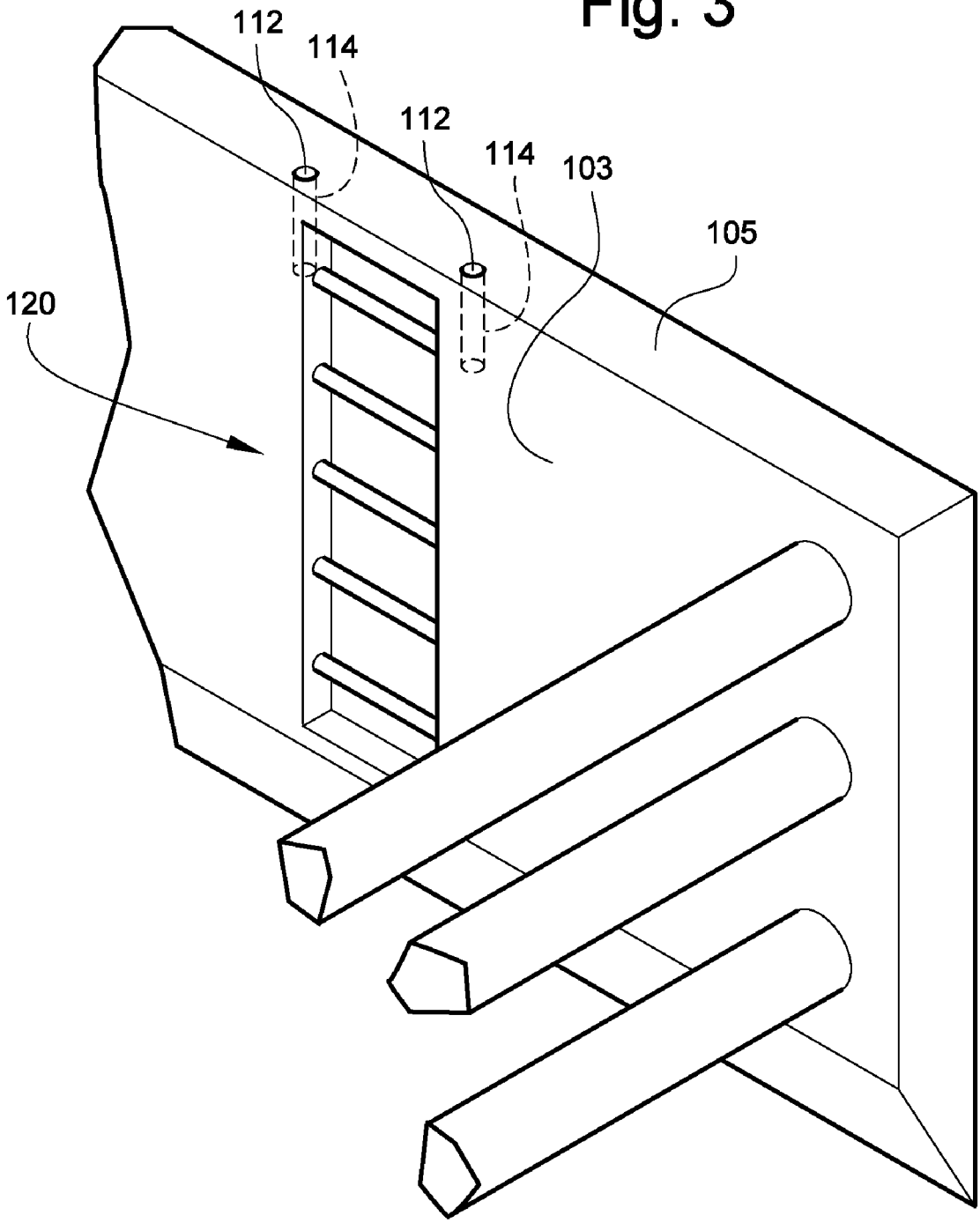
FIG. 3 illustrates a top, side perspective view of part of one side wall in a trench box of an embodiment of the present invention.

In some embodiments, the extension ladder 110 can be detachable from the side of the trench box 100. An extension ladder receiving structure may be provided that comprises openings 112 and sleeves 114. Referring to an embodiment depicted in FIG. 3, openings 112 can be located on the top face 105 positioned in proximity to the built-in ladder 120. The openings 112 can be spaced apart at a distance corresponding to the width of the extension ladder 110. The openings 112 can be created within the top face 105 of the trench box side wall. In some embodiments, the openings 112 can be created by drilling a hole within the top face 105 of the side wall and inserting a sleeve 114 that extends into the void of the top face 105. The sleeves 114 can provide support for the extension ladder 110. For example, the sleeves 114 may be a corresponding shape to the legs of the extension ladder 110 and are adapted to prevent the extension ladder 110 from slipping through openings 112. Similarly, the openings 112 comprise a shape that corresponds to the legs of the extension ladder 110 and allows entry of the legs into the sleeves 114. The shape of the openings 112 and sleeves 114 are not limited to a circular shape. Other shapes are contemplated by the present invention including, but not limited to, rectangular, square, oval, and any other like shapes.

Figure 4:
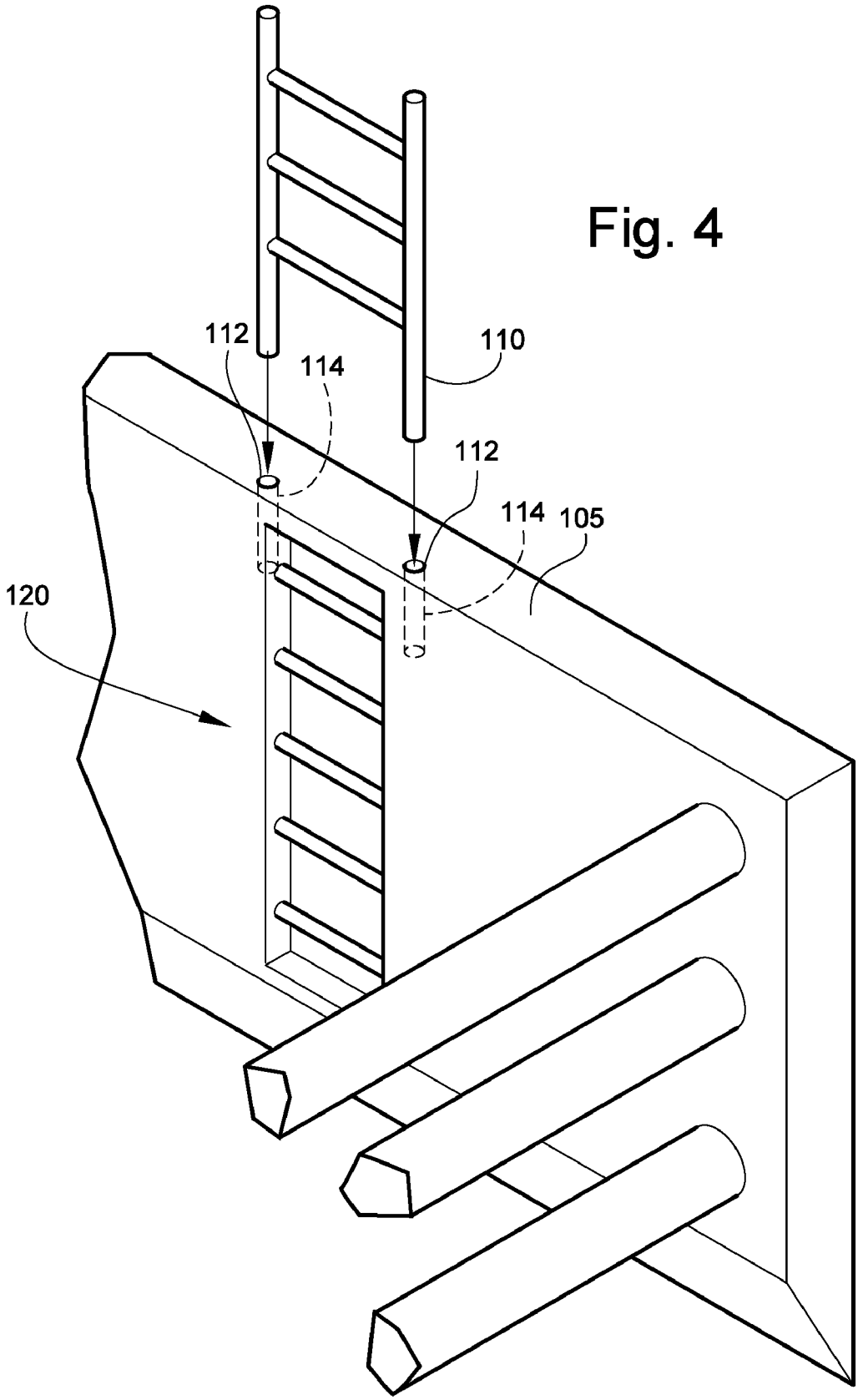
FIG. 4 illustrates a top, side perspective view of part of one side wall with an extension ladder being inserted into openings in a trench box of an embodiment of the present invention.

In one embodiment, as shown in FIG. 4, the extension ladder 110 can be inserted into the openings 112. The openings 112 can be adapted to receive the extension ladder 110. The extension ladder 110 may extend through the openings 112 such that the extension ladder 110 is attached to the trench box 100 and may not become detached while a worker is entering or exiting the trench box. In some embodiments, the extension ladder 110 inserted into the openings 112 can be attached to the trench box 100 by clips, screws, or other structures. The extension ladder 110 can have a sufficient length to provide a secure structure by which the safety ladder may be used to egress the working area. In some embodiments, the length of the extension ladder 110 inserted into the openings 112 is of sufficient length to prevent the extension ladder 110 from tipping over due to the weight of the individual using it to exit the trench box, or otherwise.

Figure 6:
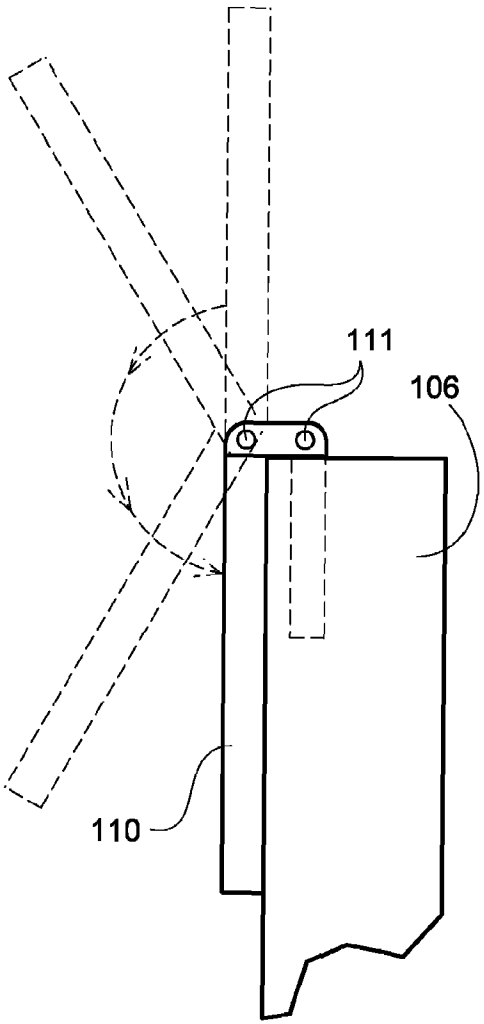
FIG. 6 is a side, elevational view of the top of a side wall of the trench box according to one embodiment of the present invention.

In another embodiment, as illustrated in FIG. 6, the extension ladder 110 may be attached to the side wall by a pivoting device 111. A pivoting device 111 may allow the extension ladder 110 to rotate 180° or less around a vertex of the pivot. The pivoting device 111 allows the extension ladder 110 to be moved to a closed position or an open position. The closed position can include the extension ladder 110 being folded against the side wall of the trench box 100. The open position can include the extension ladder 110 being extended above the top face 105 of the side wall. When the extension ladder 110 is in the closed position, the extension ladder 110 may not substantially extend beyond the top of the trench box 100, and the trench box 100 may be transported without damaging the extension ladder 110. While in the open position, the extension ladder 110 can be used to enter and exit the trench box 100. The pivoting device 111 may be locked by a pin, dial, lock, screw, clip, or other structure to prevent the extension ladder 110 from moving during use or transport.

Figure 8:
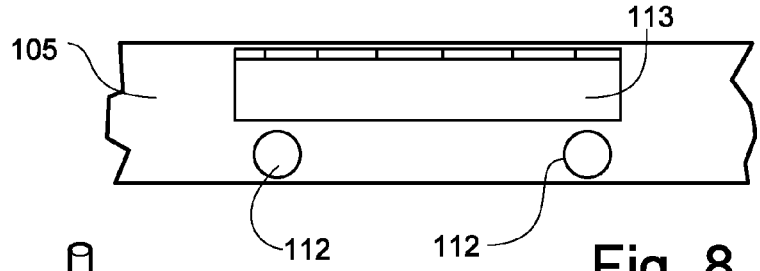
FIG. 8 is a top, plan view of the top face of the side wall illustrating an embodiment of the present invention.
Figure 7:
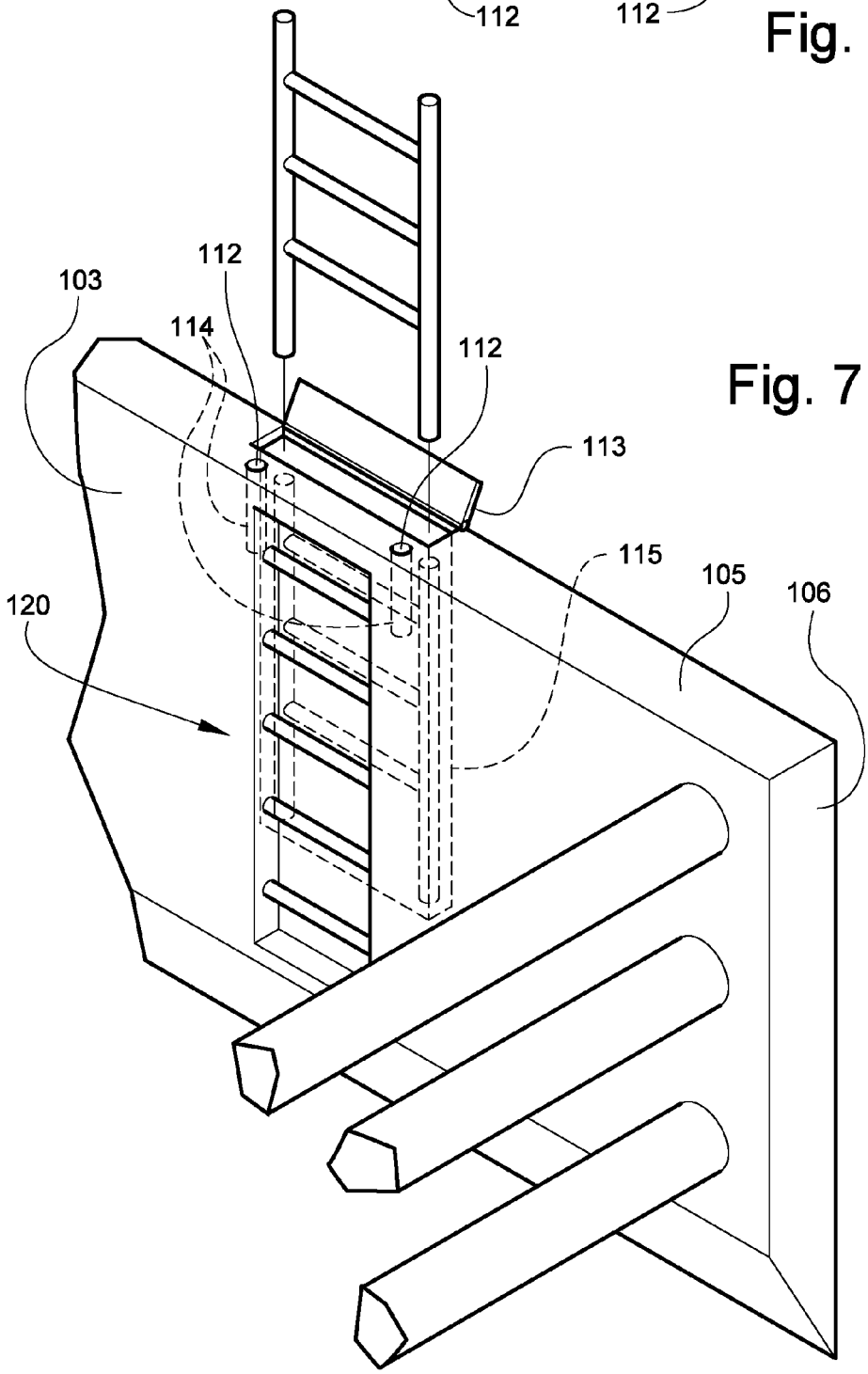
FIG. 7 is a top, side perspective view of one side wall of the trench box according to one embodiment of the present invention.

In another exemplary embodiment as illustrated in FIGS. 7 and 8, the side wall may include a storage compartment 115. As depicted in FIG. 7, the storage compartment 115 can house the extension ladder 110 within the compartment. The storage compartment 115 may include a top cover plate 113 that protects the extension ladder 110 and prevents undesired entry and exit into the storage compartment. The top cover plate 113 may be attached to the top face 105 by a hinge or other fastener. In some embodiments the storage compartment 115 can have dimensions substantially similar to that of the extension ladder 110.

FIGS. 7 and 8 show the position of the storage compartment 115 as behind the openings 112. One of ordinary skill in the art would appreciate that the position of the storage compartment 115 could be in different positions, such as but not limited to, adjacent to the openings 112.

Trench boxes accordingly to various embodiments of the present invention can be constructed in a number of ways. In some embodiments, the trench box has a steel frame with steel plates welded to the inner face and the outer face of the side walls creating a hollow space between the two faces. The hollow space allows the construction of a built-in ladder that does not protrude into the trench box. A portion of the inner face may be cut to create an opening.

In some embodiments, the present invention provides a method for retrofitting existing trench boxes with a built-in ladder and an extension ladder. For example, an existing trench box, such as trench box 100 in FIG. 1, may be provided. A cavity 102 can be created within the inner face 103. For example, a section of inner face 103 having desired dimensions can be removed. In some embodiments, walls may be attached to the boundaries of the cavity 102 to cover portions of the area where the section was removed or otherwise cover sharp edges that may form the cavity boundary. In other embodiments, walls are not attached. A plurality of rungs 104 can be attached to the side boundary of the cavity 102. For example, ends of rungs 104 can be welded, bolted, or otherwise attached to the side boundary of the cavity 102. In some embodiments, ends of rungs 104 can be attached directly to the side wall Cavity 104 can also include a cavity back wall. A back wall can be created using the removed section by cutting a portion of the removed section and attaching it to the side boundaries. In other embodiments, the back wall is the outer face 101.

Referring to FIG. 4, a top face 105 of a trench box side wall can be cut to create openings 112. The openings 112 can be located in proximity to a top of the cavity 102. For example, openings 112 may be drilled into the top face 105 with a distance between the openings substantially equal to the width of the cavity 102. Sleeves 114 may be inserted into the openings 112 and attached to the top face 105 of the side wall. In some embodiments, the extension ladder 110 can be inserted into the openings 112.

In some embodiments, a trench box may be retrofitted by cutting a second section of the top face of the side wall. The second section can be removed from the top face. A storage compartment can be created by attaching side walls to top face where the second section was removed. The storage compartment side walls extend inwardly into the trench box side wall. In some embodiments, the storage compartment can be used to house an extension ladder. As seen in FIG. 7, the second section corresponds to an opening of the storage compartment 115. Where the second section in the top face was removed, side walls can be attached which create the storage compartment 115.

In other embodiments, a method of retrofitting a trench box with a safety ladder can comprise attaching a pivot device to the top face of the side wall. The pivoting device can be also attached to the extension ladder to allow the opening and closing of the extension ladder.

The foregoing description of the exemplary embodiments of the invention has been presented only for the purposes of illustration and description and is not intended to be exhaustive or to limit the invention to the precise forms disclosed. Many modifications and variations are possible in light of the above teaching. The embodiments were chosen and described in order to explain the principles of the invention and their practical application so as to enable others skilled in the art to utilize the invention and various embodiments and with various modifications as are suited to the particular use contemplated. Alternative embodiments will become apparent to those skilled in the art to which the present invention pertains without departing from its spirit and scope.

What is claimed is:

1. A trench box comprising:

two side walls forming a working space between the side walls, each side wall comprising an inner face and a top face, wherein one side wall comprises a cavity;

a built-in ladder positioned within the cavity, wherein the built-in ladder comprises a plurality of spaced apart rungs that do not extend beyond the plane of the inner face of the side wall comprising the cavity; and an extension ladder positioned on the top face of the side wall in proximity to the built-in ladder.

2. The trench box of claim 1, further comprising a plurality of rods connecting the two side walls to each other.

3. The trench box of claim 1, wherein the extension ladder is positioned in proximity to a top of the built-in ladder.

4. The trench box of claim 1, wherein the extension ladder is detachable from the trench box.

5. The trench box of claim 1, wherein the extension ladder extends three feet above the trench box.

6. The trench box of claim 1, wherein the extension ladder extends three feet above a top of an excavation site in which the trench box is positioned.

7. The trench box of claim 1, further comprising a receiving structure positioned on the top face of the side wall, wherein the extension ladder is inserted into the receiving structure.

8. The trench box of claim 7, wherein the receiving structure comprises an opening and a sleeve.

9. The trench box of claim 1, further comprising a pivoting device, wherein the pivoting device attaches the extension ladder to the top face of the side wall.

10. The trench box of claim 9, wherein the pivoting device is adapted to allow the extension ladder to be rotated from an open position to a closed position.

11. The trench box of claim 1, further comprising at least one storage compartment, the storage compartment being located within an interior of a side wall, wherein the storage compartment is accessed from the top face of the side wall.

12. The trench box of claim 11, further comprising a top cover plate secured to the top face of the side wall via a hinge.

13. A method of retrofitting a trench box with a safety ladder, the trench box comprising a first side wall and a second side wall, each side wall having an inner face, an outer face, a top face, and two end faces, the method comprising:

forming a cavity by removing an inner face section of the first side wall, the cavity comprising cavity sides;

attaching a plurality of rungs to the cavity sides;

forming at least two openings in the top face of the first side wall, wherein the two openings are in proximity to the cavity;

inserting a sleeve into each opening; and attaching the sleeves to the first side wall top face, wherein the sleeves are adapted to receive an extension ladder.

14. The method of claim 13, further comprising inserting an extension ladder into the sleeves.

15. The method of claim 13, further comprising attaching a storage compartment to the first side wall.

16. The method of claim 13, wherein the first and second side walls comprise hollow spaces between the inner faces and outer faces.

17. The method of claim 13, wherein the first and second side walls comprise a steel frame with steel plates welded to the inner face and the outer face.

18. The method of claim 13, further comprising attaching a pivoting device to the top face of the first side wall, wherein the pivoting device is adapted to be attached to an extension ladder.

* * * * *